US009476181B2

(12) United States Patent
Tack

(10) Patent No.: US 9,476,181 B2
(45) Date of Patent: Oct. 25, 2016

(54) DRAG HEAD FOR A TRAILING SUCTION HOPPER DREDGER AND METHOD FOR DREDGING USING THIS DRAG HEAD

(75) Inventor: Bruno Tack, Assenede (BE)

(73) Assignee: Dredging International N.V., Zwijndrecht (BE)

( * ) Notice: Subject to any disclaimer, the term of this patent is extended or adjusted under 35 U.S.C. 154(b) by 845 days.

(21) Appl. No.: 13/133,859

(22) PCT Filed: Dec. 9, 2009

(86) PCT No.: PCT/EP2009/066665

§ 371 (c)(1),
(2), (4) Date: Aug. 24, 2011

(87) PCT Pub. No.: WO2010/066757

PCT Pub. Date: Jun. 17, 2010

(65) Prior Publication Data

US 2011/0296720 A1 Dec. 8, 2011

(30) Foreign Application Priority Data

Dec. 12, 2008 (BE) ..... 2008/0670

(51) Int. Cl.
*E02F 3/88* (2006.01)
*E02F 3/92* (2006.01)

(52) U.S. Cl.
CPC ..... *E02F 3/9256* (2013.01); *E02F 3/9262* (2013.01)

(58) Field of Classification Search
CPC ..... E02F 3/9256; E02F 3/9262
USPC ..... 37/307–344
See application file for complete search history.

(56) References Cited

U.S. PATENT DOCUMENTS

| | | | | | |
|---|---|---|---|---|---|
| 196,645 | A * | 10/1877 | Eads | E02F 3/9262 | 37/323 |
| 262,828 | A * | 8/1882 | Peterson | 37/342 | |
| 366,468 | A * | 7/1887 | Edwards et al. | 37/323 | |
| 396,112 | A * | 1/1889 | Rice | 37/322 | |
| 657,568 | A * | 9/1900 | Robinson | 37/333 | |
| 660,956 | A * | 10/1900 | Henderson | 37/329 | |
| 724,501 | A * | 4/1903 | Reno | 37/333 | |
| 927,690 | A * | 7/1909 | Singleton | 37/333 | |
| 1,705,428 | A * | 3/1929 | Twiford | 37/325 | |
| 1,729,054 | A * | 9/1929 | Shotwell | 37/333 | |
| 1,754,746 | A * | 4/1930 | Ewig | 37/333 | |
| 1,840,606 | A * | 1/1932 | Scheffauer | 37/333 | |
| 1,939,389 | A * | 12/1933 | Condron | 37/333 | |
| 3,305,950 | A * | 2/1967 | Hirshman et al. | 37/311 | |

(Continued)

FOREIGN PATENT DOCUMENTS

| | | | | |
|---|---|---|---|---|
| BE | WO 2012104314 A1 * | 8/2012 | ..... | E02F 3/8841 |
| EP | 0892116 | 1/1999 | | |

(Continued)

*Primary Examiner* — Thomas B Will
*Assistant Examiner* — Joan D Misa
(74) *Attorney, Agent, or Firm* — Bret E. Field; Bozicevic, Field & Francis LLP

(57) ABSTRACT

A drag head of a trailing suction hopper dredger, comprises a visor which is dragged over the bottom in a dragging direction and herein loosens soil, and a suction conduit which connects to the visor and which discharges the loosened soil. The drag head is provided with cutting bodies for loosening the soil, with the proviso that the cutting bodies comprise conical bits. Harder soil can be dredged efficiently with a trailing suction hopper dredger equipped with the drag head.

23 Claims, 2 Drawing Sheets

(56) References Cited

U.S. PATENT DOCUMENTS

| | | | | |
|---|---|---|---|---|
| 3,498,677 | A * | 3/1970 | Morrow | 299/102 |
| 3,975,842 | A * | 8/1976 | Andreae | 37/322 |
| 4,123,859 | A * | 11/1978 | de Koning | 37/325 |
| 4,150,502 | A * | 4/1979 | Sijthoff | 37/333 |
| 4,265,035 | A * | 5/1981 | Goedvolk | 37/333 |
| 4,744,158 | A * | 5/1988 | Berchem et al. | 37/457 |
| 5,379,853 | A * | 1/1995 | Lockwood et al. | 175/428 |
| 5,732,487 | A * | 3/1998 | Van De Kerckhove | 37/333 |
| 6,189,243 | B1 * | 2/2001 | Oikawa | E02F 3/88 37/195 |
| 6,449,883 | B1 * | 9/2002 | Vandycke | 37/323 |
| 6,543,963 | B2 * | 4/2003 | Bruso | 405/128.15 |
| 7,676,968 | B2 * | 3/2010 | Hall et al. | 37/460 |
| 7,690,138 | B2 * | 4/2010 | Hall et al. | 37/460 |
| 7,895,775 | B2 * | 3/2011 | Tack | 37/317 |
| 8,286,375 | B2 * | 10/2012 | Tack | 37/318 |
| 2007/0261275 | A1 * | 11/2007 | Tack | 37/335 |
| 2009/0273224 | A1 * | 11/2009 | Hall | 299/105 |
| 2010/0299972 | A1 * | 12/2010 | Tack | 37/318 |

FOREIGN PATENT DOCUMENTS

| | | | | |
|---|---|---|---|---|
| EP | 1653010 | | 5/2006 | |
| EP | 1653010 | A1 * | 5/2006 | E02F 3/9262 |
| GB | 1383089 | | 2/1975 | |
| GB | 1383089 | A * | 2/1975 | E02F 3/907 |
| GB | 2128663 | A * | 5/1984 | E02F 3/92 |
| GB | 2334272 | | 8/1999 | |
| JP | 60078026 | A * | 5/1985 | E02F 3/92 |
| SU | 1573101 | A1 * | 6/1990 | E02F 3/9262 |
| WO | WO 2006027325 | A1 * | 3/2006 | E02F 3/92 |

* cited by examiner

DRAG HEAD FOR A TRAILING SUCTION HOPPER DREDGER AND METHOD FOR DREDGING USING THIS DRAG HEAD

The invention relates to a drag head of a trailing suction hopper dredger, comprising a visor which is dragged over the bottom and herein loosens soil, and a suction conduit which is connected to the visor and which discharges the loosened soil. The invention also relates to a method for dredging soil using this drag head.

A drag head according to the preamble is known from EP-A-0892116. EP-A-0892116 describes a drag head for a trailing suction hopper dredger comprising a visor which is connected to a suction conduit and is open toward the bottom for dredging. The visor is fixed to the trailing suction hopper dredger by means of a drag pipe. A series of teeth is arranged on the visor. During the dredging the drag head with drag pipe and suction conduit is lowered under water at a generally oblique angle with a winch at the rear of the trailing suction hopper dredger, until the drag head makes contact with the bottom. During the travel of the trailing suction hopper dredger the drag head is dragged over the bottom under water, wherein the soil is loosened by the teeth engaging on the bottom. The loosened soil is suctioned away via the suction conduit, for instance to a storage space present on the trailing suction hopper dredger. During the dredging the drag head exerts pressure on the bottom due to the relatively high weight of the components situated under water, and optionally due to the suction force developed by the suction conduit. The underwater weight of the relevant components corresponds to the above-water weight thereof minus the weight of the water displaced by said components. The underwater weight of a steel component thus amounts to about ⅞ of the above-water weight (the relative specific weight of steel being approximately equal to 8).

The known drag head has the drawback that it can only be used in relatively soft soils. If the soil becomes too hard, the drag head will indeed be insufficiently able to penetrate the bottom under the weight of the partially submerged components, whereby on the one hand the teeth can no longer fulfill their function and on the other insufficient soil is suctioned up. The efficiency of the dredging production can also decrease significantly in the case of bottoms consisting only partially of harder material, since it is mainly water which is suctioned up.

The present invention has for its object to provide a drag head for a trailing suction hopper dredger which is able to dredge soil, and in particular harder soil, under water with satisfactory efficiency. Within the context of this application, efficiency is understood to mean the volume of soil dredged per unit of time.

According to the invention a drag head of a trailing suction hopper dredger is provided, which drag head comprises a visor which is dragged over the bottom in a dragging direction and herein loosens soil, and a suction conduit which connects to the visor and which discharges the loosened soil, wherein the drag head is further provided with cutting bodies for loosening the soil, with the proviso that the cutting bodies comprise bits. Using the invented drag head particularly relatively hard bottoms, such as for instance rock, can be dredged with good efficiency. Because the bits are smaller than the teeth of the known trailing suction hopper dredger, the tops of the bits come into contact with the bottom and the tops are sharper than is the case in the known teeth, the bits already penetrate the soil at relatively low forces, wherein furrows are drawn in the soil by the dragging movement of the drag head. The underwater weight of the hopper dredger is here distributed over the contact surface between the bits and the bottom. Through the use of bits a high pressure is developed locally which effectively crushes the bottom, and in particular a relatively hard bottom. It has been found that high stresses are generated in the part of the bottom between the furrows such that this part breaks easily, whereby soil chips occur which can be readily suctioned up by the suction conduit.

A preferred embodiment of the drag head according to the invention is characterized in that the bits are conical. Such a form of the bits is found to improve the efficiency of the drag head. It is further recommended that the radius of curvature of the top of the bits lies between 1 and 100 mm, more preferably between 2 and 50 mm, and most preferably between 5 and 30 mm.

It is advantageous to characterize the drag head according to the invention in that the bits form at least one series which extends or extend along a straight line substantially perpendicularly of the dragging direction. By positioning the bits in one substantially straight line it has surprisingly been found that the above discussed forming of soil chips is enhanced. The bits can in this way co-act optimally. Having the bits co-act achieves that the total volume of broken rock is many times greater than the cumulative volume of rock which would be broken by the individual bits.

The number of bits of the drag head according to the invention can be chosen within wide limits. In a preferred embodiment of the invented drag head the number of bits of the drag head is higher, and more preferably significantly higher, than the number of teeth of the known drag head. The known drag head is generally provided with about 5 to 10 teeth, this depending on the size of the drag head. A higher number of cutting bodies results in a lower average penetration depth of the cutting bodies in the bottom.

Surprisingly, the therefore anticipated lower efficiency is fully compensated by applying bits. Because the forces on the bits are better distributed, it also becomes possible to give the overall drag head a larger and heavier form (for instance an above-water weight of 100 tons) than has heretofore been usual (the known drag head generally weighs 20-50 tons on shore). A heavier and larger drag head further increases the dredging efficiency. The number of bits in a series preferably amounts to at least 10, more preferably at least 15 and most preferably at least 20. The number of series preferably lies between 1 and 10, more preferably between 1 and 5, and the number of series most preferably amounts to 2. This preferred variant results in a good compromise between efficiency and the power required to drag the drag head along.

The mutual distance between the bits is determined by, among other factors, the dimensions of the bits themselves and by the total underwater weight of the drag head components, divided by the number of bits (=average vertical force on the bits). The developed dragging force can also be important. In addition, the properties of the soil for dredging are important, for instance the pressure strength/tensile strength ratio of the bottom, preferably rock. It has been found that a further improvement in efficiency is achieved by a drag head wherein the distance in the dragging direction between two successive series of bits and/or the intermediate distance perpendicularly of the dragging direction between two successive bits in the same series is a maximum of 10 times the penetration depth of the bits in the rock, and still more preferably a maximum of 5 times the penetration depth of the bits in the rock.

The bits can in principle be positioned in all possible ways in the longitudinal direction of the drag head (the direction parallel to the dragging direction). In order to further increase the dredging efficiency, it is advantageous to dispose adjacent series of bits offset relative to each other. A better cutting efficiency is hereby obtained.

Although different variants are possible, the bits are generally received in a transverse beam of the drag head, wherein it is advantageous to receive each series of bits in a separate transverse beam, which is moreover connected still more preferably to the drag head such that it can be translated with a certain counterpressure in a direction substantially perpendicularly of the bottom. The counterpressure can for instance be generated by suspending the transverse beams resiliently in the drag head. Thus embodied transverse beams have the advantage that the contour of the bottom can be followed with greater accuracy.

In order to further increase efficiency, the drag head is preferably provided with a series of teeth which extend substantially transversely of the dragging direction and which during use preferably engage on the bottom downstream of the bits. The teeth can further break down ground portions already (partially) broken by the bits. If the teeth are placed upstream of the bits, the teeth can also level the bottom, whereby the bits can do their work more efficiently. The combination of teeth and bits provides for an increased efficiency.

A further improved drag head is obtained when it is provided with support means which during use engage on the bottom upstream of the bits, and optionally of the teeth. In the case of great unevenness in the bottom these support means ensure that the drag head, or at least the visor, are forced to follow the contour of the bottom. This prevents jamming of and/or damage to the drag head, and in particular the bits. In a particularly suitable embodiment the support means comprise a number of slide blocks preferably disposed in the transverse direction. The slide blocks are profiled such that the drag head does not tend to dig itself in but, on the contrary, tends to follow the bottom contour. The slide blocks hereby have a protective function.

The bits will generally sink a certain penetration depth into the bottom under the weight of the drag head. This typical penetration depth can be determined during design of the bits. It is advantageous here if the underside of the support means is positioned at a predetermined, preferably limited distance above the underside of the bits (in use therefore the top of the bits which comes into contact with the bottom).

In a further improved preferred embodiment the drag head according to the invention is provided with closing means for at least partially closing the opening between components, and in particular between visor and bottom. Providing closing means achieves that the suction force supplied through the suction conduit will as it were suction the drag head onto the bottom. The developed suction force ensures sufficient pressure stress under the bits and optionally the teeth in the bottom, so that the bottom breaks, chips or otherwise collapses. The closing of the opening between the visor and the bottom can be embodied in any manner known to the skilled person. The closing means can thus comprise a strip of flexible material, this strip spanning the opening and being fixed to the relevant component on at least one side of the opening.

The drag head according to the invention preferably comprises bits of relatively small dimensions relative to the known cutting tools. A suitable overall length of a bit preferably amounts to between 20 and 400 mm. Suitable transverse dimensions preferably amount to between 10 and 100 mm. The bits can be attached in any manner to the drag head. Particularly suitable is receiving the bits in holders, which are then fixed to a transverse beam of the drag head. In a preferred embodiment the bits have a length protruding outside the holder (the active length) lying between 10 and 500 mm. The active length of the bits still more preferably lies between 20 and 250 mm, and most preferably between 50 and 150 mm. The drag head according to the invention has the additional advantage that the overall vertical force is distributed over more bits, whereby the average forces on these latter are significantly lower than on normal teeth. The bits can hereby be manufactured from harder material than the known teeth, whereby they will be less susceptible to wear. Because they are applied under water, the bits are also cooled, which further increases their lifespan.

If desired, the drag head according to the invention can be provided with at least one series of jet pipes for injecting a liquid, preferably water, preferably under high pressure. High pressure is understood to mean pressures which preferably amount to 1500 bar, more preferably to 2000 bar, most preferably to 2500 bar. The efficiency of the bits is hereby increased further. According to the invention the jet pipes can in principle be disposed in front of, behind or at the position of the bits. It is also possible to provide the bits themselves with jet pipes. These are then embodied for instance as a central bore. The jet pipes can assist in discharging already broken soil parts via the suction conduit and/or in further reducing in size and/or fluidizing these soil parts. It is also possible for the jet pipes to assist in removing softer soil layers from soil that has not yet broken, so that a better defined ground surface is created into which the bits can penetrate better. Jet pipes arranged in a bit have the advantage that liquid under high pressure can penetrate into already partially formed cracks and can therefore accelerate breaking of the soil. This can also prevent, or at least slow down, wear of the bits.

The invention also relates to a method for breaking and/or dredging of at least partially hard bottoms under water with a trailing suction hopper dredger, equipped with a drag head according to the invention. The method comprises of lowering a drag head according to the invention onto the bottom, after which it is dragged over the bottom. A suction force is herein exerted through the suction conduit on the space at least partially closed off via closing means (13) and enclosed by the visor and the bottom, so that the bits penetrate via their peripheral edge into the bottom and cause cracks therein under the influence of the weight of the drag head and the suction force. The broken-off soil chips are suctioned up through the suction conduit. According to the invention the bits herein draw furrows in the relatively hard bottom, wherein the part of the bottom situated between the furrows is likewise broken. In a preferred method the drag head is provided with support means and these support means engage first on the bottom, wherein the drag head is forced to follow the contour of the bottom, after which the bits then engage on the bottom.

The drag head according to the invention is particularly suitable for dredging bottom under water with a UCS ('Unconfined Compressive Strength') of at least 5 MPa, preferably at least 20 MPa, and most preferably at least 40 MPa. It has been found that the drag head according to the invention produces the best results in the UCS range between 5 and 50 MPa. At a UCS of less than 5 MPa the advantages gained are not great enough relative to the known drag head equipped with teeth.

The drag head and method according to the invention will now be further elucidated on the basis of the following description of preferred embodiments and figures, without the invention being limited thereto. In the figures.

Figure 1:
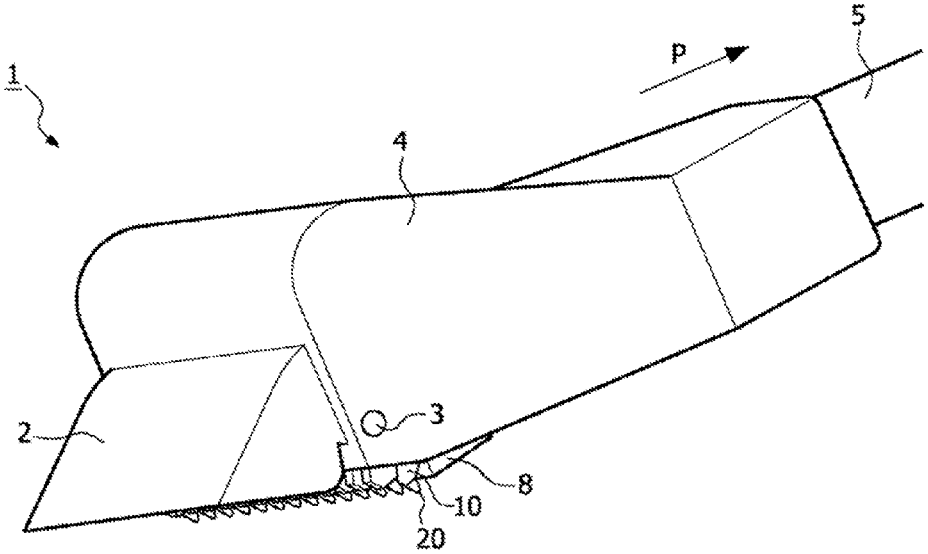
FIG. 1 shows a schematic perspective view of a drag head according to the invention.
Figure 2:
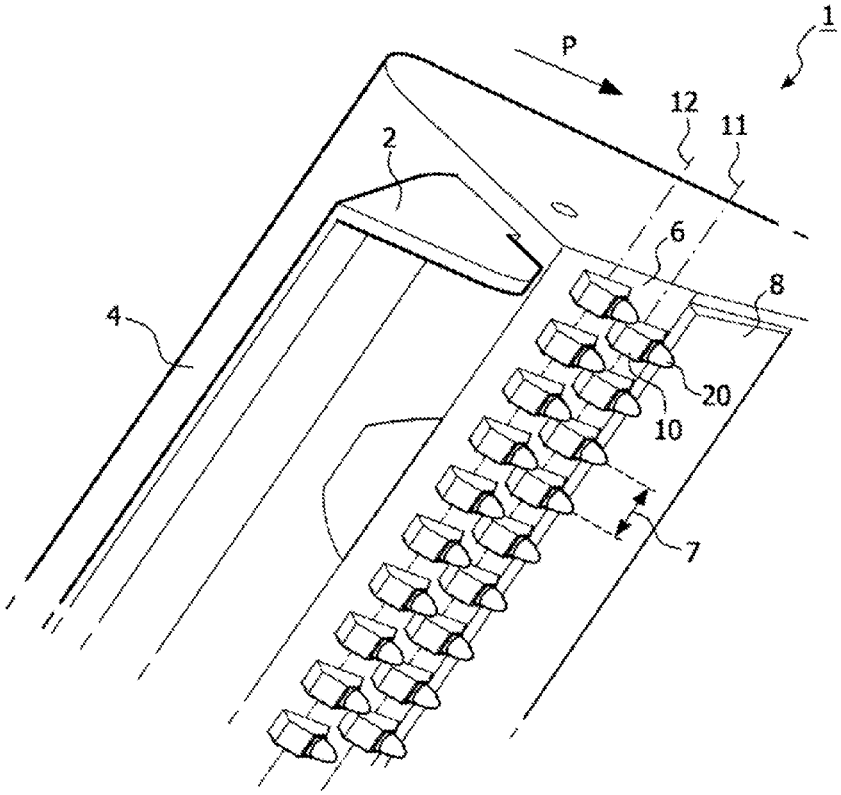
FIG. 2 shows a schematic perspective bottom view of a part of the drag head of FIG. 1.
Figure 3:
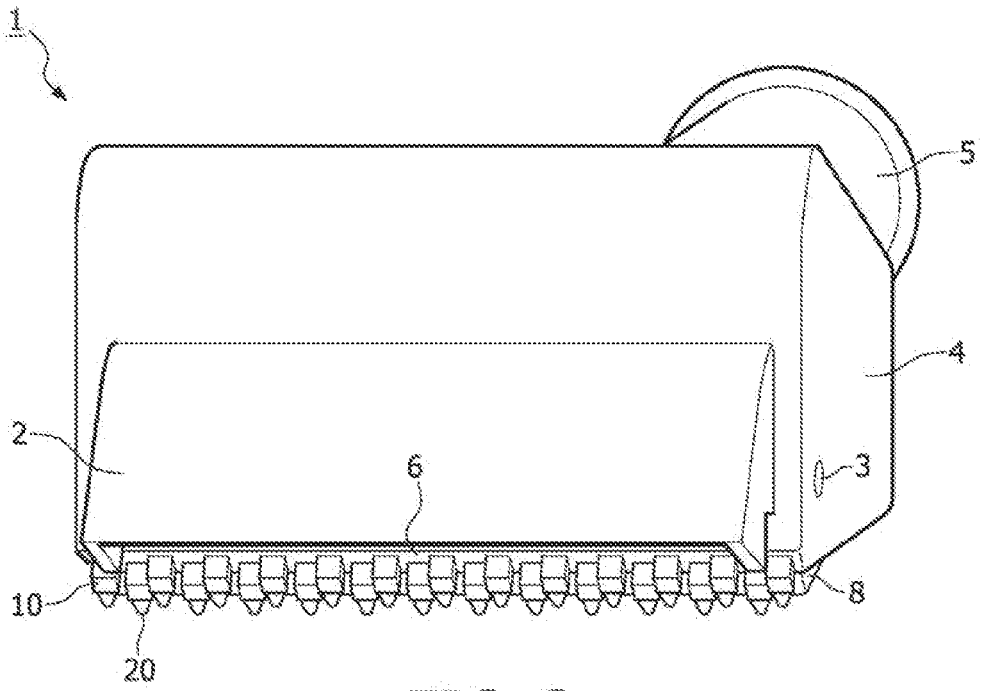
FIG. 3 shows a schematic perspective front view of the drag head of FIG. 1.

A drag head 1 for a trailing suction hopper dredger is shown with reference to FIG. 1.

Drag head 1 comprises a visor 2 which during use is dragged over the bottom in the dragging direction P and herein loosens soil, and a suction conduit 3 which connects to visor 2 and discharges the loosened soil. Visor 2 is connected rotatably about hinge 3 to outer end 4 of suction conduit 5. In the shown embodiment of the drag head according to the invention drag head 1 is provided with cutting bodies for loosening the soil. The cutting bodies comprise conical bits 20 which are received in holders 10. Holders 10 are mounted on a transverse beam 6 which is fixedly connected to part 4 of the drag head. In the shown embodiment variant a total of 23 bits 20 are received in transverse beam 6 via holders 10. Bits 20 form two series which extend along two straight lines 11 and 12, wherein straight lines 11 and 12 run substantially perpendicularly of dragging direction P. Bits 20 of series 11 are arranged offset relative to bits 20 of series 12, whereby the intermediate distance between the furrows drawn by bits 20 can be influenced so that the optimal distance between the bits can be chosen. Offset placing of bits further provides for an improved cutting efficiency. This increases the dredging efficiency. It will be apparent that, if desired, the intermediate distance between bits 20 can be varied and may optionally also differ, for instance per series.

Drag head 1 is further provided with support means in the form of slide block 8, which in use engages on the bottom upstream of bits 20. Slide block 8 extends in transverse direction over substantially the full width of the drag head. Slide block 8 tapers in the dragging direction P so that drag head 1 does not tend to dig itself into the ground but, on the contrary, follows the bottom contour.

Figure 4:
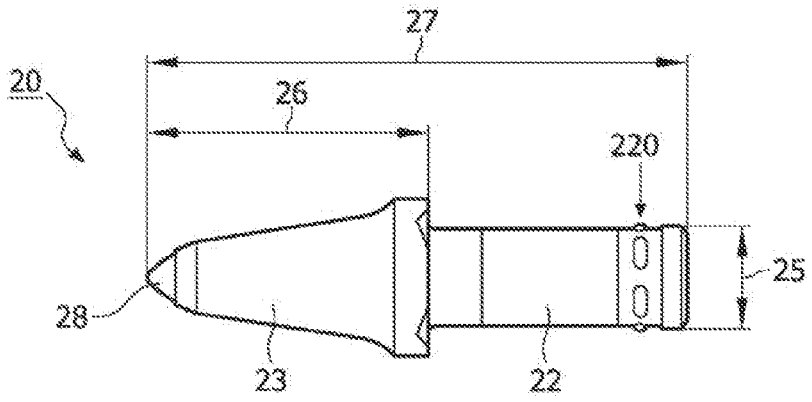
FIG. 4 shows a side view of a detail of a cutting tool according to the invention.

An embodiment of a bit 20 is shown with reference to FIG. 4. The shown bit 20 with overall length 27 comprises a substantially cylindrical part 22 with diameter 25 and a conical second part 23. Bit 20 can be arranged with cylindrical part 22 in a holder 10 of drag head 1, for instance by means of snap connection 220. A permanent connection is also possible, or other form of releasable connection. In the situation in which bit 20 is arranged in holder 10 the conical part 23 will protrude outside the holder over an active length 26. Conical part 23 of bit 20 is provided with a hardened tip 28 at the outer end which comes into contact with the soil. The appropriate radius of curvature of the tops of bits 20 depends on, among other factors, the properties of the bottom and on the specific design of the drag head, but preferably lies between 1 and 100 mm. A suitable overall length 27 of a bit 20 preferably amounts to between 20 and 400 mm. Suitable transverse dimensions 25 preferably amount to between 10 and 100 mm. In a preferred embodiment the bits have a length 26 protruding outside the holder lying between 10 and 500 mm, more preferably between 20 and 250 mm, and most preferably between 50 and 150 mm.

During the dredging an underpressure is maintained inside drag head 1 to enable the loosened hard soil particles and other soil particles to be suctioned up via suction conduit 3. The method according to the invention comprises of lowering drag head 1 to the underwater bottom and dragging drag head 1 over the bottom in the dragging direction P. A suction force is herein exerted by suction conduit 3 on the at least partially closed off space enclosed by visor 2 and the bottom so that bits (20) penetrate into the bottom and cause cracks therein under the influence of the weight of the drag head. By applying a large number of bits (20) positioned adjacently of each other it has been found that the bottom between bits (20) is also crushed, whereby the efficiency is considerable. The broken-off bottom chips are suctioned up through suction conduit 3. When the bottom is uneven, support means (8) will make first contact with the bottom. The distance between the underside of support means (8) and the underside of the bits can be chosen such that the cutting height of these bits is limited to a chosen maximum. The bits are thus protected from excessive individual cutting forces, and the overall cutting force on the drag head is also limited. It can also be advantageous to provide a drag head with teeth (9), wherein bits (20) first engage on the bottom with a determined penetration depth so that the bottom is at least partially broken, after which the teeth than engage on the bottom.

The invention is not limited to the above described exemplary embodiments, and modifications can be made thereto to the extent these fall within the scope of the appended claims.

The invention claimed is:

1. A drag head of a trailing suction hopper dredger, comprising a visor which is dragged over a bottom in a dragging direction and herein loosens soil, and a suction conduit which connects to the visor and which discharges the loosened soil, wherein the bottom comprises a rock bottom, and wherein the drag head is further provided with cutting bodies for loosening the soil, wherein the cutting bodies comprise conical bits each having a top with a radius of curvature between 1 and 100 mm, wherein the conical bits form at least one series which extends along a straight line substantially perpendicular to the dragging direction, wherein each of the at least one series comprises at least 15 conical bits, the conical bits being configured to draw furrows in the rock bottom in the dragging direction, wherein a part of the bottom situated between the furrows is broken into chips which are readily suctioned up by the suction conduit.

2. The drag head as claimed in claim 1, characterized in that the number of series lies between 1 and 10.

3. The drag head as claimed in claim 2, characterized in that the number of series amounts to 2.

4. The drag head as claimed in claim 1, characterized in that the drag head is provided with support means which during use engage on the bottom upstream of the bits.

5. The drag head as claimed in claim 4, characterized in that the support means comprise slide blocks.

6. The drag head as claimed in claim 4, characterized in that the bits have a penetration depth and that the support means engage on the bottom higher than the bits.

7. The drag head as claimed in claim 1, characterized in that the drag head is provided with closing means which substantially close the opening between the visor and bottom.

8. The drag head as claimed in claim 1, wherein the drag head further comprises holders configured to receive the conical bits, wherein each bit includes an inner end and an outer end, and wherein the bits are connected at their inner ends to the holders.

9. The drag head as claimed in claim 8, wherein the bits are fixedly connected to the holders.

10. The drag head as claimed in claim 8, wherein the bits are releasably connected to the holders.

11. The drag head as claimed in claim 8, wherein the outer end of each bit comprises a hardened tip configured to contact the soil.

12. The drag head as claimed in claim 8, wherein each conical bit protrudes from one of the holders toward the dragging direction.

13. The drag head as claimed in claim 1, characterized in that the number of series lies between 1 and 5.

14. The drag head as claimed in claim 1, wherein the conical bits form at least two series which each extend along a straight line substantially perpendicular to the dragging direction.

15. The drag head as claimed in claim 1, wherein the drag head further comprises holders for receiving the conical bits, wherein each bit includes an inner end and an outer end, wherein the bits are connected at their inner ends to the holders, and wherein each conical bit protrudes from one of the holders toward the dragging direction.

16. The drag head as claimed in claim 15, wherein the drag head comprises a top surface and a bottom surface and the holders are mounted on and extend from the bottom surface.

17. The drag head as claimed in claim 15, wherein each holder comprises a receptacle for receiving a conical bit therein and wherein the outer end of each bit is configured to maintain contact with the bottom while the visor is dragged over the bottom.

18. The drag head as claimed in claim 1, wherein the cutting bodies are each mounted on the drag head upstream in the dragging direction with respect to the visor.

19. The drag head as claimed in claim 1, wherein the distance in the dragging direction between two successive series of bits is a maximum of 10 times the penetration depth of the bits in the rock bottom.

20. The drag head as claimed in claim 1, wherein the intermediate distance perpendicularly of the dragging direction between two successive bits in the same series is a maximum of 10 times the penetration depth of the bits in the rock bottom.

21. The drag head as claimed in claim 1, wherein the conical bits are mounted on a transverse beam fixedly connected to the drag head.

22. A method for dredging at least partially hard bottoms under water with a trailing suction hopper dredger, equipped with a drag head as claimed in claim 1, wherein the drag head is lowered onto the bottom and dragged thereover, wherein a suction force is exerted through the suction conduit on the at least partially closed space enclosed by the visor and the bottom, so that the bits penetrate into the bottom and cause cracks therein under the influence of the weight of the drag head and the underpressure, and wherein the broken-off soil chips are suctioned up through the suction conduit.

23. The method as claimed in claim 22 for dredging bottoms under water with a UCS ('Unconfined Compressive Strength') of at least 20 MPa.

* * * * *